United States Patent [19]

Hultgren

[11] Patent Number: 4,671,898

[45] Date of Patent: Jun. 9, 1987

[54] PROCESS FOR TREATMENT OF A SPENT, RADIOACTIVE, ORGANIC ION EXCHANGE RESIN

[75] Inventor: Ake V. Hultgren, Nyköping, Sweden

[73] Assignee: Studsvik Energiteknik AB, Nyköping, Sweden

[21] Appl. No.: 717,172

[22] PCT Filed: Jul. 19, 1984

[86] PCT No.: PCT/SE84/00265

§ 371 Date: Mar. 21, 1985

§ 102(e) Date: Mar. 21, 1985

[87] PCT Pub. No.: WO85/00922

PCT Pub. Date: Feb. 28, 1985

[30] Foreign Application Priority Data

Aug. 4, 1983 [SE] Sweden ..... 8304278

[51] Int. Cl.[4] ..... G21F 9/16

[52] U.S. Cl. ..... 252/628; 110/237; 159/47.3; 252/626; 252/631

[58] Field of Search ..... 252/628, 631, 632, 626, 252/629; 110/237, 238, 250, 252; 159/47.3, 46, DIG. 12; 106/90, 97

[56] References Cited

U.S. PATENT DOCUMENTS

| | | | |
|---|---|---|---|
| 3,479,295 | 11/1969 | Thompson | 252/632 |
| 3,988,258 | 10/1976 | Curtiss et al. | 252/628 |
| 4,008,171 | 2/1977 | Tiepel et al. | 252/632 |
| 4,053,432 | 10/1977 | Tiepel et al. | 252/632 |
| 4,122,048 | 10/1978 | Buchwalder et al. | 252/628 |
| 4,204,974 | 5/1980 | Puthawala et al. | 252/632 |
| 4,268,409 | 5/1981 | Ga et al. | 252/632 |
| 4,401,591 | 8/1983 | Korostenski | 252/629 |
| 4,460,500 | 7/1984 | Hultgren | 252/632 |
| 4,499,833 | 2/1985 | Grantham | 252/632 |
| 4,530,723 | 7/1985 | Smeltzer et al. | 106/90 |

FOREIGN PATENT DOCUMENTS

| | | | |
|---|---|---|---|
| 2356246 | 12/1977 | France | 252/628 |
| 6014195 | 2/1981 | Japan | 252/628 |
| B387190 | 8/1976 | Sweden . | |
| B425708 | 10/1982 | Sweden . | |
| 1086719 | 10/1967 | United Kingdom . | |

*Primary Examiner*—Stephen J. Lechert, Jr.
*Assistant Examiner*—Howard J. Locker
*Attorney, Agent, or Firm*—Burns, Doane, Swecker & Mathis

[57] ABSTRACT

A spent, radioactive, organic ion exchange resin is converted into a stable inorganic product having a considerably reduced volume in the following way. The radioactive ion exchange resin is mixed with a salt and an inorganic sorbent for radioactive nucleides, liberated by the salt, the mixture is dried and incinerated, whereupon the ash is solidified in cement.

19 Claims, No Drawings

PROCESS FOR TREATMENT OF A SPENT, RADIOACTIVE, ORGANIC ION EXCHANGE RESIN

TECHNICAL AREA

The present invention relates to a process for the treatment of a spent, radioactive, organic ion exchange resin to reduce the volume thereof and to obtain a stable final product. In the context ion exchange resin primarily means a cationic exchange resin but also an anionic exchange resin and an exchange resin of the mixed bed type, containing cation exchanger as well as anion exchanger, can be advantageously treated in accordance with the invention. The invention primarily relates to the treatment of such ion exchange resins which have been utilized to purify cooling water in a nuclear reactor, and the water in a pool for the storage of spent nuclear fuel.

TECHNICAL BACKGROUND

It is previously known to solidify a spent ion exchange resin in cement or bitumen. However, by such a measure the volume is heavily increased. Furthermore, in the case of solidification in cement, the stability against leaching is not very good. In the case of solidification in bitumen the fire hazards thereof is a problem.

Moreover, it is previously known, for instance from Swedish patent specification No. 8101801-2, that the volume of a spent ion exchange resin can be reduced by an incineration thereof. According to said Swedish patent specification the incineration residue is then heated to sintering or melting, a stable product being obtained thereby. The measure of cementing the incineration residue has been considered improper due to the bad stability against leaching which has been observed when solidifying a non-incinerated ion exchange resin in cement.

DISCLOSURE OF THE INVENTION

It has now been found that in an unexpectedly simple way it is possible to reduce the volume of the spent ion exchange resin as well as to prepare a cement matrix wherein the radioactive nucleides are bound in a stable way. The process according to the invention is characterized by mixing the ion exchange resin partly with a salt, to liberate radioactive substances from the ion exchange resin, partly with an inorganic sorbent for the radioactive substances thus liberated, then drying and incinerating the mixture, and solidifying in cement the residue from the incineration.

The salt may be added to the aqueous ion exchanger in a solid form or as an aqueous solution thereof. The salt is preferably added in such a quantity that the ion exchanger will be saturated. The cation of the salt should effectively elute active ions, such as $Cs^+$-ions, wich are sorbed on the ion exchanger. In order to obtain such an elution it is possible to utilize several common water-soluble salts, such as calcium nitrate or aluminium nitrate.

However, according to the invention it is preferable to use water-soluble salts, the anions of which tend to liberate active nucleides, such as cobolt, zinc, through the formation of complexes, for instance salts of phosphoric acid, citric acid, tartaric acid, oxalic acid, formic acid, propionic acid. It has turned out that such complex-forming anions do not disturb the subsequent process steps, i.e. the incineration and cementation operations, and that said organic acids are eliminated in the incineration step. As cations of the salt calcium and aluminium are preferred. These salts are conducive to a favourable course of incineration. The explanation thereto seems to be that after their sorption on the ion exchanger the salts make said ion exchanger rather heavy, which facilitates the incineration. Furthermore, these salt reduce the tendency to an agglomeration of the ion exchange resin grains, which results in a larger contact surface towards the incineration air and a more rapid incineration. Salts of calcium and aluminium make the incineration residue more compatible with the cement matrix, and accordingly the solidification in cement will be facilitated.

The inorganic sorbent should be added in such an amount that it completely sorbs the liberated radioactive nucleides. Preferably the sorbent has a particle size of 10–100 μm. During the incineration operation the sorbent will retain radioactive nucleides, such as Cs-137, by converting them into stable compounds having low vapour pressures at high temperatures. Furthermore the sorbent imparts to the final product a good stability against leaching of radioactive nucleides from the cement matrix, which effect is especially pronounced for Cs-137. As said sorbent we prefere to utilize titanates or titanium hydroxide, zirconates or zirconium hydroxide or zirconium phosphate, aluminates or aluminium hydroxide, alumino silicates such as bentonite or a natural or synthetic zeolite, or a mixture of two or more of these sorbents.

The ion exchange resin, the salt and the sorbent are preferably admixed at a temperature of 20°–70° C., and the aquous admixture is preferably dried at 90°–120° C. The dried admixture is preferably incinerated at 500°–900° C., preferably at about 800° C., suitably in air that has been enriched to an oxygen content of 30–40% by volume. The residue from the incineration is mixed with cement and water. The water content of the mixture is preferably between 10 and 20% by weight. The precentage of the residue from the incineration should be at most 120% of the weight of the cement. In connection with the invention cement preferably means Portland cement, but also similar aqueous-hardening binders. The cement mixture is now cast in a mould, wherein it is allowed to harden, and the hardened body is allowed to dry.

Our examinations show that the volume of the final or end product can be reduced up to 1/10 as compared to a direct solidification of a spent ion exchange resin in cement. It has also been found that the stability against leaching is increased at least ten times as compared to said direct cementation.

EXAMPLE

A spent radioactive organic ion exchange resin contained inter alia 10 kBq of Cs-137 per gram of resin. The resin had a dry solids content of 50% by weight and was of the mixed-bed type, the ratio of cationic exchanger-:anionic exchanger being 1:1. 100 grams of said resin were mixed with 25 grams of calcium formate and 4 grams of bentonite. The mixture was dried at 110° C. and incinerated at 700° C. in air that had been enriched on oxygen. An incineration residue of 15 grams was then obtained. This was mixed with 15 grams of Portland cement and 6 grams of water and from the mixture there was cast a cube having a volume of 20 $cm^3$. After said cube had hardened leaching tests showed that Cs-137 was leached at room temperature with a rate of about $10^{-5}$ g/cm$^2$·d.

I claim:

1. A process for treatment of a spent, radioactive, organic ion exchange resin to reduce the volume thereof and to obtain a stable end product comprising mixing the ion exchange resin with a salt, which liberates radioactive substances from said ion exchange resin, as well as with an inorganic sorbent for the radioactive substances thus liberated, then drying and incinerating said mixture and solidifying the residue from the incineration in cement.

2. A process according to claim 1 wherein the salt is added in such a quantity that the ion exchange resin will be essentially saturated.

3. A process according to claim 1 wherein the salt is a salt of aluminum or calcium.

4. A process according to claim 1 wherein the salt is a salt of phosphoric acid, citric acid, tartaric acid, oxalic acid, formic acid or proponic acid.

5. A process according to claim 1 wherein the sorbent is a titanate or titanium hydroxide, a zirconate or a zirconium hydroxide or zirconium phosphate, an aluminate or an aluminum hydroxide, an alumino silicate such as bentonite or a natural or synthetic zeolite, or a mixture of two or more of these sorbents.

6. A process according to claim 1 wherein the dried mixture is incinerated at a temperature of 500°–900° C.

7. A process according to claim 6 wherein the dried mixture is incinerated in oxygen-enriched air.

8. A process according to claim 2 wherein the salt is a salt of aluminum or calcium.

9. A process according to claim 2 wherein the salt is a salt of phosphoric acid, citric acid, tartaric acid, oxalic acid, formic acid or propionic acid.

10. A process according to claim 2 wherein the sorbent is a titanate or titanium hydroxide, a zirconate or a zirconium hydroxide or zirconium phosphate, an aluminate or an aluminum hydroxide, an alumino silicate such as bentonite or a natural synthetic zeolite, or a mixture of two or more of these sorbents.

11. A process according to claim 3 wherein the sorbent is a titanate or titanium hydroxide, a zirconate or a zirconium hydroxide or zirconium phosphate, an aluminate or an aluminum hydroxide, an alumino silicate such as bentonite or a natural synthetic zeolite, or a mixture of two or more of these sorbents.

12. A process according to claim 4 wherein the sorbent is a titanate or titanium hydroxide, a zirconate or a zirconium hydroxide or zirconium phosphate, an aluminate or an aluminum hydroxide, an alumino silicate such as bentonite or a natural synthetic zeolite, or a mixture of two or more of these sorbents.

13. A process according to claim 8 wherein the sorbent is a titanate or titanium hydroxide, a zirconate or a zirconium hydroxide or zirconium phosphate, an aluminate or an aluminum hydroxide, an alumino silicate such as bentonite or a natural synthetic zeolite, or a mixture of two or more of these sorbents.

14. A process according to claim 9 wherein the sorbent is a titanate or titanium hydroxide, a zirconate or a zirconium hydroxide or zirconium phosphate, an aluminate or an aluminum hydroxide, an alumino silicate such as bentonite or a natural synthetic zeolite, or a mixture of two or more of these sorbents.

15. A process according to claim 2 wherein the dried mixture is incinerated at a temperature of 500°–900° C.

16. A process according to claim 3 wherein the dried mixture is incinerated at a temperature of 500°–900° C.

17. A process according to claim 4 wherein the dried mixture is incinerated at a temperature of 500°–900° C.

18. A process according to claim 5 wherein the dried mixture is incinerated at a temperature of 500°–900° C.

19. A process according to claim 15, wherein the dried mixture is incinerated in oxygen-enriched air.

* * * * *